United States Patent [19]

Eiermann

[11] 4,207,039

[45] Jun. 10, 1980

[54] SEAL GRID SYSTEM FOR A ROTARY PISTON MECHANISM

[75] Inventor: Dankwart Eiermann, Lindau, Fed. Rep. of Germany

[73] Assignees: Wankel GmbH, Berlin, Fed. Rep. of Germany

[21] Appl. No.: 932,050

[22] Filed: Aug. 9, 1978

[30] Foreign Application Priority Data

Aug. 22, 1977 [DE] Fed. Rep. of Germany ..... 2737758

[51] Int. Cl.[2] ..... F01C 1/02; F01C 19/08

[52] U.S. Cl. ..... 418/77; 418/81; 418/113; 418/142

[58] Field of Search ..... 418/61 A, 77, 81, 142, 418/54, 113

[56] References Cited

U.S. PATENT DOCUMENTS 2,940,399 6/1960 Zieg et al. ..... 418/77

3,955,904 5/1976 Catterson ..... 418/142

*Primary Examiner*—John J. Vrablik

*Attorney, Agent, or Firm*—Arthur L. Frederick; Arthur L. Frederick

[57] ABSTRACT

The seal grid system for a rotary piston mechanism of the Wankel-type comprises apex seal blades, a conventional side seal assembly consisting of side seal strips and button or seal pins carried on one side face of the rotary piston and a sealing surface portion or rib projecting axially from the other side face of the rotary piston and extending endlessly around the rotor face. The seal surface portion is spaced radially inwardly from the peripheral surfaces of the rotary piston to expose a portion of the other side face to the pressurized gases in the working chambers so that the axial forces on each of the side faces of the rotary piston are at least in part counter-balanced.

4 Claims, 5 Drawing Figures

FIG. 1
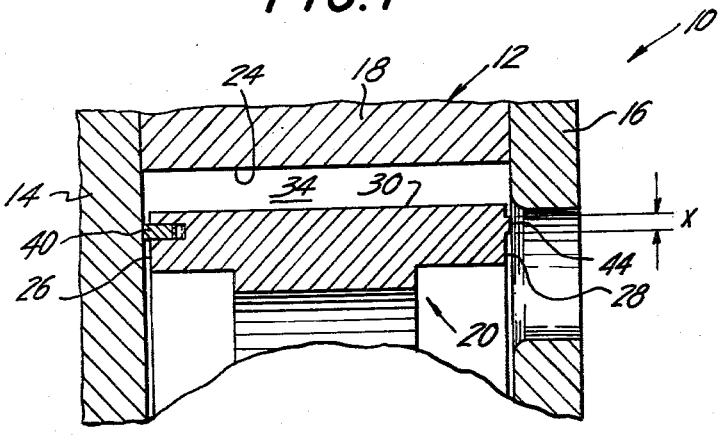
FIG. 2
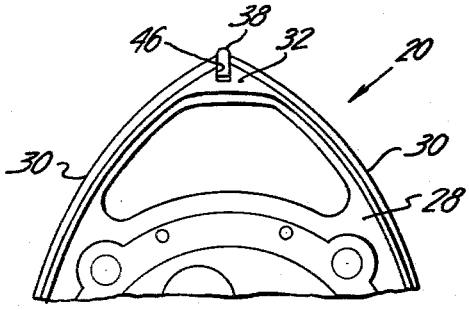
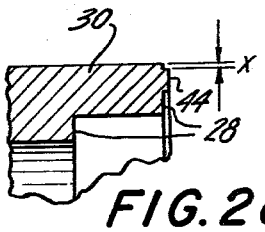
FIG. 2a
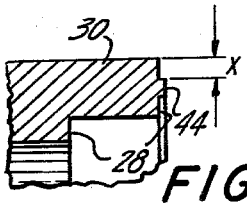
FIG. 2b
FIG. 3
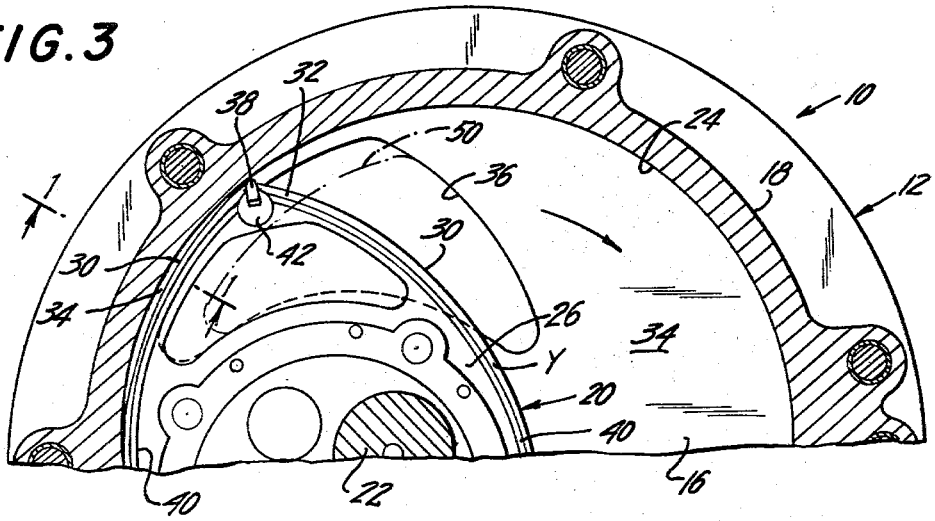

SEAL GRID SYSTEM FOR A ROTARY PISTON MECHANISM

This invention relates to rotary piston mechanisms of the type disclosed in the U.S. Pat. No. 2,988,065, to Wankel et al, dated June 13, 1961 and, more specifically, to a seal grid system for such mechanisms.

BACKGROUND OF THE INVENTION

In Wankel et al-type rotary piston mechanisms having a housing comprising end walls spaced apart by a peripheral wall to define therebetween a trochoidal-shaped cavity of one or more lobes and having a piston or rotor, consisting of opposite side faces and a profile forming two or more apex portions, supported for planetary rotary motion in the cavity, a relatively expensive seal grid system is provided. Such sealing grid systems conventionally comprise apex seals at the apex portions of the rotor for engaging the inner surface of the peripheral housing wall, a plurality of side seal strips carried in each side face of the rotor to engage the adjacent inner surface of the end walls, and seal pins carried at each of the apex portions of the rotor to seal the interstices between the side seal strips and apex seals. Also, the seal grid usually includes an oil seal ring carried in each rotor face radially inwardly of the gas seal strips. Each of these aforementioned sealing components are usually biased into engagement with the housing surfaces by springs and/or fluid pressure. Obviously, the fabrication and assembly of such sealing grid systems is time-consuming and costly. In small mechanism applications, as for example, lawn mowers, chain saws, pumps and the like, such relatively expensive sealing grid systems may reduce the competitive advantages of the Wankel-type mechanisms over conventional small reciprocating piston mechanisms. One kown simplified sealing grid system comprises the elimination of the gas seal strips and seal pins on one side face of the rotor and in place thereof provides the rotor with axially extending surfaces for abutment against the inner surface of the adjacent end housing wall. This construction has the disadvantage that the pressure differential acting on the opposite side faces of the rotor applies an axial force against the rotor in a direction toward the rotor side face which has no seal strips or pins to thereby cause too high a friction between that rotor face and the adjacent end wall of the housing.

Accordingly, it is an object of this invention to provide a sealing grid system for a Wankel-type mechanism which is relatively simple, inexpensive and obviates the necessity for apex pins and seal strips on at least one rotor face.

It is an object of this invention to provide a seal grid system for a Wankel-type mechanism which is relatively simple, inexpensive and yet is relatively effective. It is a further object of the present invention to provide a seal grid system for a Wankel-type mechanism which is simple and inexpensive and wherein friction between the rotor and the housing walls is not excessive.

It is a still further object of this invention to provide a seal grid system for a Wankel-type mechanism which is sufficiently effective to be suitable for small sized mechanisms where efficiency is not of paramount importance.

Another object of the present invention is to provide a seal grid system for a Wankel-type mechanism which system permits the use of a side inlet or intake port of larger size than possible with a conventional seal grid system.

A feature of the seal grid system of this invention is the use of conventional seals on one side face of the rotor and sealing axial projections integral with the other side face such that the gaseous pressure forces acting axially on the rotor side faces are substantially balanced.

SUMMARY OF THE INVENTION

Accordingly, the present invention contemplates a novel seal grid system for a Wankel-type mechanism.

The Wankel-type mechanism comprises a rotor having opposite side faces and peripheral surfaces intersecting each other to form apex portions and which rotor is supported for planetary rotation within a housing cavity formed by a peripheral wall and opposite end walls. The rotor and housing walls define therebetween a plurality of working chambers within which fluids are pressurized. The housing walls have intake and exhaust ports for permitting flow of fluids into and from the working chambers.

The seal grid system comprises an apex seal means carried in each apex portion of the rotor to engage the peripheral wall of the housing. It also has a side seal assembly which may be of the conventional type having spring and/or pressure biased side seal strips carried in one side face of the rotor. The side seal assembly is spaced radially inward of the peripheral surfaces of the rotor so that a portion of the one side face is exposed to the fluid pressures in the working chambers. In accordance with this invention the seal grid system further includes a sealing surface portion projecting axially from the other side face of the rotor to engage the adjacent end wall of the housing and extending endlessly or continuously around the rotor side face. The sealing surface portion is spaced radially inward of the peripheral surface of the rotor to expose a portion of the other or associated side face to the pressurized fluids in the working chambers. This spacing permits the axial forces acting on the other side face of the rotor to be offset, at least in part, by the axial forces acting on the said one side face in the opposite direction. This counter-acting force avoids the heretofore problem of excessive friction between the sealing surface portion and the adjacent housing end wall. The amount that the sealing surface portion can be spaced inwardly of the peripheral surfaces of the rotor is dependent on the characteristics of the rotary piston mechanism. If the mechanism is well lubricated, a high pressure load in a direction toward the sealing surface portion is tolerable and therefore the sealing surface portion can be spaced from the peripheral surfaces of the rotor to a lesser extent than if the mechanism was not well lubricated. However, if only a very low friction can be tolerated, e.g. a mechanism where the housing end walls or the rotor are of synthetic material, then the sealing surface portion must be spaced radially inward from the peripheral surfaces of the rotor to substantially the same distance the side seal assembly is radially spaced from the peripheral surfaces of the rotor. Any spacing of the sealing surface portion greater than the spacing of the side seal assembly would provide an axial force differential across the rotor in the opposite direction which would result in interruption of the sealing effect of the lubricant between the sealing surface portion and the adjacent housing end wall.

It is preferred that the sealing surface portion extend into the apex portions of the rotor to coact with the apex seal means to seal the apex area against pressurized fluid flow past the sealing portion and apex seal means.

In a rotary piston mechanism having an intake port or ports in one of the end walls of the housing of the mechanism, the sealing surface portion of the rotor is disposed adjacent such end wall. This arrangement enables the intake port to be made of larger size, since the elimination of a seal pin or button on such rotor side face obviates the necessity for providing end wall surface for retaining the seal pin in its recess in the rotor apex portion; thus intake port can be of relatively large size.

BRIEF DESCRIPTION OF THE DRAWING

The invention will be more fully understood from the following detailed description thereof when considered in connection with the accompanying drawing in which:

FIG. 1 is a fragmentary cross-sectional view of a rotary piston mechanism taken substantially along line 1—1 of FIG. 3 showing the seal grid system according to this invention;

FIG. 2 is a fragmentary view in elevation of the side face of the rotor shown on the right as viewed in FIG. 1;

FIGS. *2a* and *2b* show fragmentary sectional views of the sealing surface portion of the rotor according to this invention showing two radially, inwardly spaced positions of such sealing surface portion from the peripheral surfaces of the rotor;

FIG. 3 is a fragmentary cross-sectional view of a rotary mechanism having a seal grid system of this invention and a side intake port in a housing end wall.

DESCRIPTION OF THE PREFERRED EMBODIMENT

Now referring to the drawing and more specifically FIGS. 1 and 3, the reference number 10 generally refers to a rotary piston mechanism of the Wankel type which is provided with a seal grid system, according to this invention. It is to be understood that while the invention is shown and will be described as applied to a rotary piston mechanism 10 having a two sided rotor supported for rotation in a single lobe housing cavity, the invention is not limited thereto. The mechanism 10 may have a three or more sided rotor in a housing cavity of two or more lobes without departure from the scope and spirit of this invention. In computing the number of rotor sides and house cavity lobes, the number of rotor sides is one more than the number of cavity lobes.

The mechanism 10 comprises a housing 12 defined by two end walls 14 and 16 held in spaced parallel relationship to each other by a peripheral wall 18. The housing 12 forms a cavity in which a rotary piston or rotor 20 is supported eccentrically on a mainshaft 22 for planetary rotation. The peripheral wall may have an inner surface 24 of trochoidal configuration.

The rotor 20 comprises two opposite side faces 26 and 28 and peripheral or flank surfaces 30 which intersect each other to form apex portions 32 (only one being shown). The rotor 20 is supported within the housing cavity so that side faces 26 and 28 are adjacent to the inner surfaces of end walls 14 and 16, respectively. The rotor 20 and housing 12 define within the housing cavity a plurality of working chambers 34 which successively expand and contract in volumetric size as rotor 20 planetates relative to housing 12.

The mechanism 10 also has suitable intake and discharge ports to effect passage of fluid into and out of working chambers 34. In FIG. 3 is shown only one such port 36 in the end wall 16.

The seal grid system for mechanism 10, according to this invention, comprises an apex seal means 38 (only one of which is shown) carried in each of the apex portions 32 of rotor 20 to engage inner surface 24 of peripheral wall 18, a side seal assembly consisting of a plurality of seal strips 40 which are carried in side face 26 of rotor 20 and a seal pin or button 42 to seal the area adjacent apex seal means 38 and the ends of seal strips 40. In addition, the seal grid system includes a sealing surface rib or portion 44 axially extending from side face 28 of rotor 20.

The apex seal means 38 may be of any suitable construction comprising a single or multi-piece blade slidably disposed in a radially extending groove 46 in apex portions 32 and with biasing means (not shown) such as a fluid pressure and/or mechanical means (a spring or springs) for urging the blade out of its groove and into continuous contact with inner surface 24 of peripheral wall 18.

The side seal assembly likewise may be of any suitable construction in which a seal strip 38 is disposed for slidable, axial movement in a groove in the rotor face and biased in a direction outwardly of the groove by a biasing means (not shown), such as fluid pressure and/or mechanical means. In usual side seal assemblies, the mechanical means is a spring or springs. Also, as is conventional, the supporting grooves are spaced radially inward from peripheral surfaces 30 a distance designated in FIG. 3 by the letter "Y".

The button seals 42 may be of any suitable construction which usually comprises a biasing means (not shown) such as fluid pressure and/or mechanical means, for urging an associated button seal 42 outwardly of an axially extending recess in the apex portion of the rotor, the button seal 42 having a groove for receiving the apex seal means 38.

The sealing surface 44, as well as extending axially from side face 28, extends endlessly circumferentially. Preferably, as shown only in FIG. 2, sealing surface portion 44 extends into apex portions 32 of rotor 20 to embrace apex seal means 38 and to coact with the latter to effect sealing in the apex area of rotor 20.

The spacing of the seal strips 38 of the side seal assembly from peripheral surfaces 30 a distance "Y" exposes portions of the side face 26 to pressurized fluid in working chambers 34 which exerts an axial force on rotor 20 in a direction toward end wall 16. This force can cause excessive frictional engagement of sealing surface portion 44 against end wall 16. To obviate this problem, sealing surface portion 44 is spaced radially inwardly of peripheral surfaces 30 of rotor 20 to thereby expose a portion of side face 28 of rotor 20 to the same pressurized fluid in working chambers 34, thus providing a force on rotor 20 acting in a direction opposite of the pressure acting on side face 26 of the rotor.

As shown in FIGS. *2a*, sealing surface portion 44 is spaced from peripheral surface 30 of rotor 20 a relatively small distance designated by the letter "X", while in FIG. *2b*, sealing surface portion 44 is spaced a greater distance "X" from peripheral surface 30 of rotor 20 than is shown in FIG. *2a*. The arrangement shown in FIG. *2a* is suitable for mechanisms 10 which can be well lubricated and, therefore, the imbalance of forces acting on rotor 20 and the attendant friction between sealing surface portion 44 and end wall 16 are of minor concern. The arrangement illustrated in FIG. 2*b* is desirable for mechanisms 10 where frictional resistance between sealing surface portion 44 and end wall 16 must be minimal. The spacing distance "X" in the arrangement of FIG. 2*b* is made substantially that of distance "Y", but preferably should not exceed the distance "Y". If the distance "X" is greater than "Y", then an axial pressure differential across the rotor will result in a force urging the rotor in a direction toward end wall 14, resulting in ineffective sealing at sealing surface portion 44.

As shown in FIG. 3 the sealing grid system according to this invention locates the sealing surface portion 44 on the rotor face adjacent the end wall in which a side port 36 is located. This permits side port 36 to be larger in size than would be possible where the conventional side seal assembly and button seal 42 is located. To retain button seal 42 in its associated recess, the button seal 42 must always bear against the adjacent housing end wall and, therefore, side port 36 would be constructed as shown by the broken lines 50. Obviously, the side port 36, constructed to prevent button seal 42 from falling into and striking the edges of such port, is of smaller dimensions than side port 36 when disposed adjacent the sealing surface portion 44. The provision of a larger side port 36 when it serves as an intake, provides for the admittance of greater amounts of fluid per unit time into working chambers 34 thus permitting the mechanism to operate at higher speeds.

It is now believed apparent that the present invention provides a sealing grid system for a rotary piston mechanism which is relatively simple and inexpensive and yet where undue friction losses are obviated. It is a sealing grid system for a rotary piston mechanism having a side intake port which permits the mechanism to operate at relatively high speeds.

Although but one embodiment has been illustrated and described in detail, it is to be understood that the invention is not limited thereto. Various changes can be made in the arrangement of parts without departing from the spirit and scope of the invention as the same will now be understood by those skilled in the art.

What is claimed is:

1. In a rotary piston mechanism comprising a rotor having opposite side faces and peripheral surfaces intersecting each other to form apex portions and which rotor is supported for planetary rotation within a housing cavity formed by a peripheral wall and opposite end walls, the rotor and housing walls defining therebetween a plurality of working chambers within which fluids are pressurized, a seal grid system comprising:

(a) an apex seal means for each apex portion to engage the peripheral wall of the housing;

(b) a side seal assembly carried on one side face of the rotor for sealing the interstices between the said one side face and the adjacent end wall of the housing;

(c) said side seal assembly being radially spaced inward of the peripheral surfaces of the rotor so that a portion of said one side face is exposed to the fluid pressures in the working chambers; and (d) a sealing surface portion forming an integral part of and projecting axially from the other side face of the rotor to engage the adjacent end wall of the housing and extending endlessly around the rotor side face and spaced radially inward of the peripheral surface of the rotor to expose a portion of said other side face to the pressurized fluids in the working chambers so that the axial forces acting on the other side face of the rotor offsets, at least in part, the axial forces acting on the said one side face in the opposite direction.

2. The apparatus of claim 1 wherein said rotary piston has intake and discharge ports and wherein at least one of said ports is provided in the housing end wall adjacent the other side face of the rotor.

3. The apparatus of claim 1 wherein the sealing surface portion is spaced radially inward from the peripheral surfaces of the rotor a distance substantially equal to the distance side seal assembly on said one side face is spaced radially inward from the peripheral surfaces of the rotor.

4. The apparatus of claim 3 wherein the sealing surface portion extends into the apex portions of the rotor to coact with the apex seal means to seal the apex area against radial flow of pressurized fluid and prevent pressurized fluid by-passing the apex seal means.

* * * * *